US006148576A

United States Patent [19]

Janopaul, Jr.

[11] Patent Number: 6,148,576

[45] Date of Patent: Nov. 21, 2000

[54] ENERGY CONSERVING WALL UNIT AND METHOD OF FORMING SAME

[76] Inventor: Peter Janopaul, Jr., c/o Graystone Block Company, Inc. 316 W. River Rd., Modesto, Calif. 95351

[21] Appl. No.: 09/136,474

[22] Filed: Aug. 19, 1998

[51] Int. Cl.[7] ..... E04B 1/02

[52] U.S. Cl. ..... 52/426; 52/379; 52/564; 52/741.13; 52/742.13; 52/745.09

[58] Field of Search ..... 52/565, 564, 426, 52/425, 424, 741.13, 742.13, 745.09, 379, 294, 381

[56] References Cited

U.S. PATENT DOCUMENTS

| | | | |
|---|---|---|---|
| 312,305 | 2/1885 | Trmbull . | |
| 364,241 | 6/1887 | Frost | 52/564 |
| 836,017 | 11/1906 | Douglass . | |
| 962,463 | 6/1910 | Phillips | 52/565 X |
| 1,084,098 | 1/1914 | McIntyre . | |
| 1,417,399 | 5/1922 | McCurry . | |
| 1,702,964 | 2/1929 | Goudis . | |
| 1,708,696 | 4/1929 | Hellerman | 52/379 X |
| 1,725,200 | 8/1929 | Lampert | 52/379 |
| 2,002,820 | 5/1935 | Liptak | 52/564 |
| 2,172,051 | 9/1939 | Robbins . | |
| 2,172,052 | 9/1939 | Robbins . | |
| 3,546,833 | 12/1970 | Perreton . | |
| 4,263,765 | 4/1981 | Maloney . | |
| 4,566,238 | 1/1986 | Janopaul . | |
| 4,597,236 | 7/1986 | Braxton | 52/564 |
| 4,606,169 | 8/1986 | Noon et al. | 52/424 X |
| 4,622,796 | 11/1986 | Aziz et al. | 52/379 X |
| 5,035,099 | 7/1991 | Lapish | 52/565 X |
| 5,456,052 | 10/1995 | Anderson et al. | 52/565 X |
| 5,570,552 | 11/1996 | Nehring | 52/564 X |
| 5,669,198 | 9/1997 | Ruff | 52/656.4 |
| 5,809,728 | 9/1998 | Tremelling | 52/565 X |
| 5,845,448 | 12/1998 | Potvin | 52/565 X |

*Primary Examiner*—Beth A. Stephan
*Assistant Examiner*—Brian E. Glessner
*Attorney, Agent, or Firm*—Flehr Hohbach Test Albritton & Herbert LLP

[57] ABSTRACT

A wall which is energy conserving, particularly useful for a prison or other types of buildings, has a security inner structural element structure which may be formed of concrete blocks, the outer facings of which are formed with vertical sockets shaped as mortise grooves. Spaced outwardly from the inner structural element is a decorative weatherskin element, the inner faces of which are also formed with vertical sockets. Horizontal spacers interconnect the inner and the outer elements so that there is a space therebetween. The spacers have enlarged heads at either end which are received in the sockets, then twisted and hold the two elements a given distance apart. The space between the two walls is filled by pouring insulating material such as polyurethane foam. Alternatively the outer structural element may be formed of clay bricks or other facing materials, one end of the spacers being paddle shaped to fit into the mortar joint between courses of bricks.

25 Claims, 3 Drawing Sheets

ENERGY CONSERVING WALL UNIT AND METHOD OF FORMING SAME

BACKGROUND OF THE INVENTION

1. Field of the Invention

This invention relates to a new and improved energy conserving wall unit and method of forming same. More particularly, the invention relates to a wall unit having an inner wall portion preferably formed of concrete blocks, the outer faces of which are formed with outward facing sockets. Spaced outward from the inner wall portion is an outer wall portion comprising a weatherskin face shell formed of units having sockets facing inward. Spacers having enlarged heads are inserted into the sockets in the inner wall and outer wall. The space between the two wall members is filled with insulation material such as foam polyurethane. The weatherskin face shell protects the insulation.

2. Description of Related Art

This invention comprises an improvement upon U.S. Pat. No. 4,566,238 issued Jan. 28, 1986 on Energy Conserving Concrete Masonry Unit, Wall Construction And Method. The '238 patent discloses a concrete masonry unit for use in constructing the exterior walls of a building in a manner providing improved passive solar heating and nocturnal cooling of the exterior of the building. The '238 patent is manufactured in a dual cavity mold as a single unit. The present invention pertains more particularly to an improved concrete masonry unit made of three pieces of the type where the wall insulation can be readily enclosed to lie alongside a concrete structural wall portion, with the insulation between the two wall portions. Heat conduction between the inner and outer wall portions is reduced because the connection (third piece) between the inner wall portion and outer wall portion of each unit is of limited cross-sectional area and has improved K (thermal conductivity) values when compared to the concrete crosswebs of the '238 patent, for example, or steel connectors.

SUMMARY OF THE INVENTION

The wall hereinafter described provides an improved insulating unit for retaining heat within a building during winter when passive solar heating principles may cut energy consumption and which also serves to inhibit the transfer of heat from external surfaces of the wall to internal surfaces thereof during summer when nocturnal cooling principles may be used to cut energy consumption. Thus the concrete masonry unit, as used in the form of a shell around a building, provides substantially enhanced thermal inertia or thermal mass to the building.

In general, a first and second substantially parallel wall are disposed to form a rectangular space therebetween as viewed in plan. Spacers interconnect the two walls. The cross sectional area and material of construction of the spacers is such that very little heat transfer occurs through the spacers between the two walls. Thus energy conservation is achieved and is enhanced by using insulation material between the two walls. A suitable insulating material is foam polyurethane which is poured between the two walls after they have been constructed.

By reducing the cross sectional area interconnecting the two walls, substantial energy conservation is obtained.

Other features and advantages of the invention will appear from the following description in which the preferred embodiments have been set forth in detail, in conjunction with the accompanying drawings.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Figure 1:
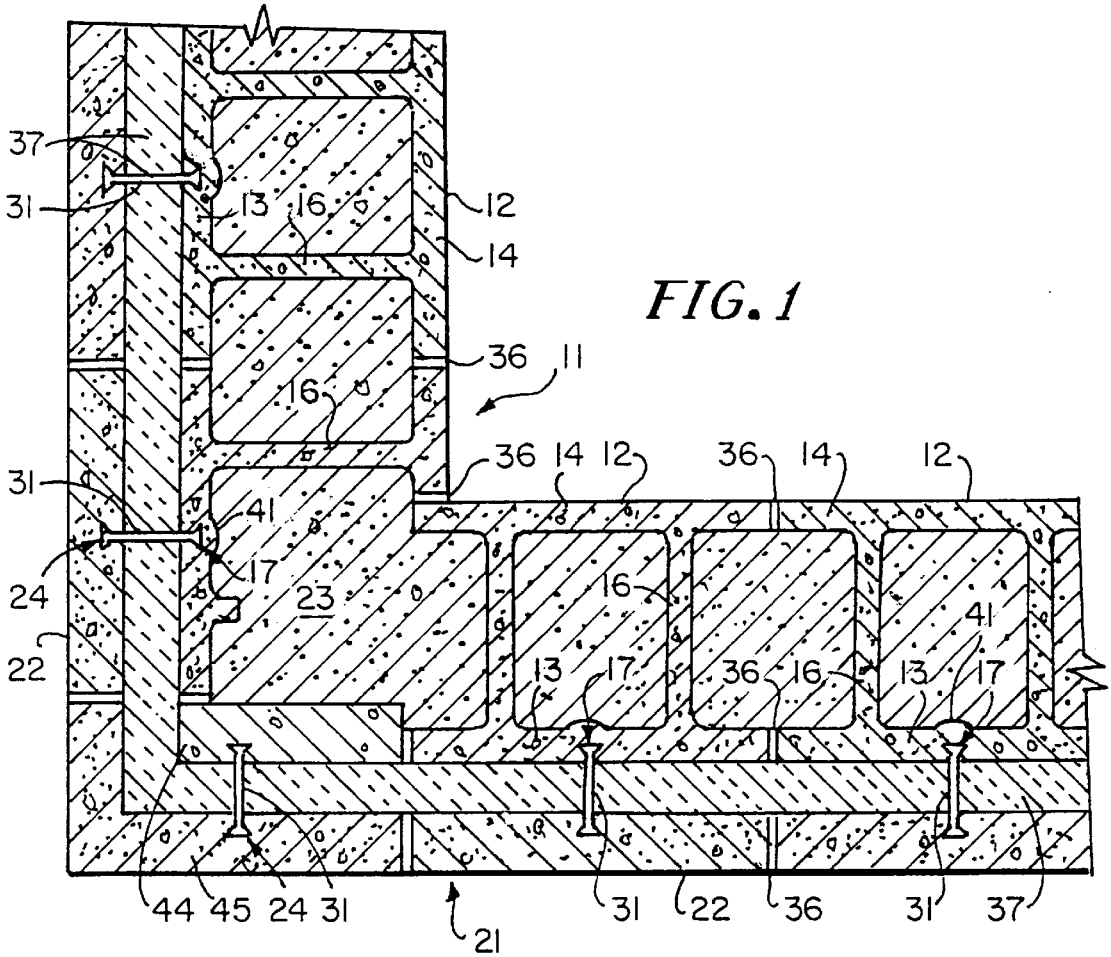
FIG. 1 is a horizontal sectional view of a portion of a wall constructed in accordance with one modification of the present invention.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

The wall unit of the present invention comprises an inner structural element 11 and an outer weatherskin element 21 spaced therefrom. Inner structural element 11 may be made in various ways. As here shown the inner wall 11 is comprised of concrete blocks 12 nominally of 12" width, 8" height and 16" length dimensions. Such width dimensions are subject to considerable variation. Each block 12 has an outer face shell 13, nominally 1¼ inches thick, and inner face wall 14 of similar thickness and interconnecting crosswebs 16. The number and positioning of the crossweb 16 as well as the length which governs the wall thickness is, of course, subject to considerable variation. In accordance with the present invention, however, one or more outward-facing grooves or receptors 17 extend vertically in outer face shell 13 preferably from top to bottom of face shell 13. Each groove 17 has a throat 18 having parallel sides and inwardly of throat 18 is an enlarged dovetail mortise slot configuration 19. The shape of dovetail slot 19 is subject to variation and may be shapes other than the mortise shape illustrated herein. To accommodate recessing groove 17 deeply in face shell 13, a boss 41 may be formed on the opposite side of shell 13 to prevent weakening of the shell. Instead of concrete masonry blocks 12, other materials of construction may be used, including poured concrete.

Outer wall or weather surface 21 is made up of face shell units 22 preferably having decorative external surfaces. The vertical and horizontal dimensions of the face shell units 22 may match those of concrete blocks 12 (i.e. nominally 8" high×16" long) and the thickness may be preferably a nominal 3 inches. Such wall width dimensions of the structural elements are also subject to variation as dictated by wall loading and other factors well understood in the construction industry. Grooves or receptors 24 are formed in the interior surface of each face shell unit 22 preferably immediately opposed to grooves 17. Thus, each groove 24 may have a throat 26 and inwardly of the throat a dovetail cross-section slot 27. In a preferred form, grooves 24 terminate half way down the interior surface in a horizontal shelf 29 whereas grooves 17 extend the entire height of face shell 13.

Spacers 31 interconnect the outer face shells 13 of structural element 11 and weatherskin units 22. Preferably each spacer has a central portion 32 having a dimension slightly less than throats 18 and 26 to permit 90° rotation. The ends 33 of each spacer are complementary to the dovetails 19 and 27 and comprise tenons for the mortises. The ends 33 are sufficient smaller than dovetails 19 and 27 to permit the spacer to be twisted 90° about its longitudinal axis after insertion. The length of central portion 32 depends upon the distance between dovetail slot 19 and 27.

Concrete masonry units (e.g. blocks) 12 are laid in courses in conventional running bond manner, the concrete masonry blocks of each course being offset one-half the length of blocks of the previous course. Mortar 36 is laid between the upper and lower edges as well as the ends of outer and inner face shells 13 and 14. This is, of course, in accordance with conventional building construction. The cavities in these blocks may be filled with concrete grout 23 with or without reinforcing bars (not shown), also in accordance with well known construction practice.

As the courses of blocks 12 are being laid, face shell units 22 may likewise be laid with a space nominally 2½ inches or lesser or greater depending upon the desired thermal resistance between the inner structural element 11 and the outer wall 21. Units 22 may, of course be laid later at a different (e.g., later) time than inner structural element 11.

Figure 5:
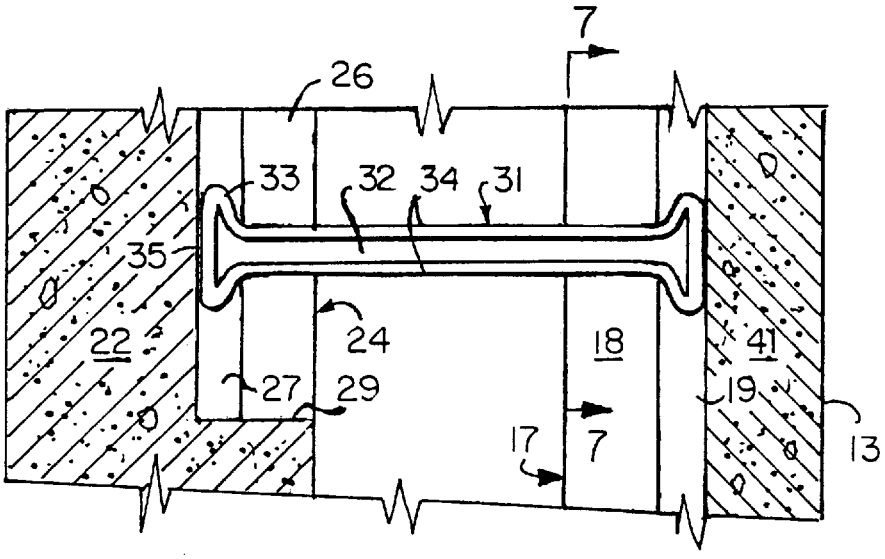
FIG. 5 is a fragmentary sectional view taken substantially along the line 5—5 of FIG. 2 showing a preliminary step in the insertion of a spacer into sockets of the inner and outer wall members.
Figure 6:
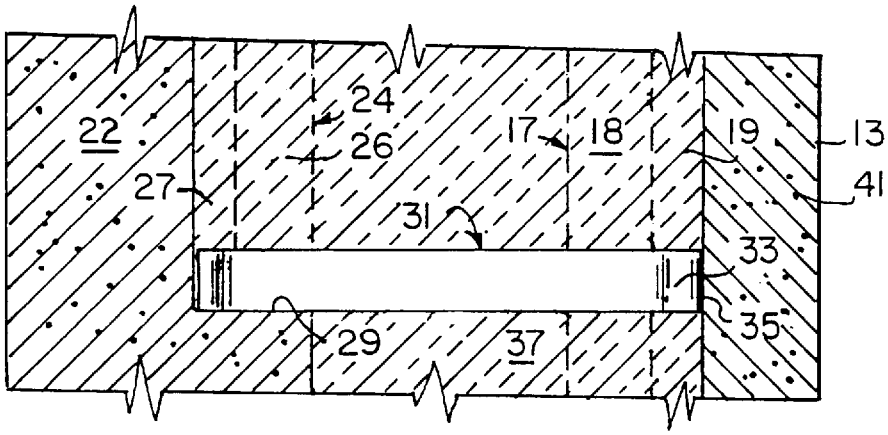
FIG. 6 is a view similar to FIG. 5 showing completion of the insertion of the spacer, by rotating 90° within the two sockets.
Figure 7:
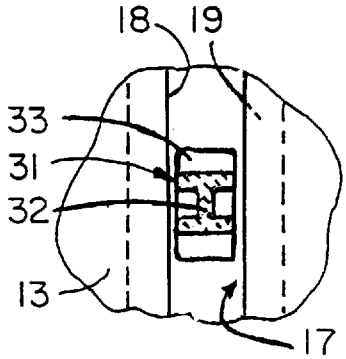
FIG. 7 is a view similar to FIG. 2 of a modification before rotating 90°.

To tie the inner structural element and outer weatherskin face shell together and maintain parallelism thereof, spacers 31 are employed. Spacers 31 are preferably cast of glass fiber reinforced resin and have high tensile strength and substantially less heat transfer than metal or masonry ties. Spacer 31 has a center 32 which has thickened edges 34 so that it appears "H" shaped in cross-section as best shown in FIG. 7. Dovetail or tenon ends 33 complementary to mortise grooves 17 and 24 are shaped to receive the dovetail tenons 33 to form a connection and also have thickened edges 35. The shape of connector 31 is subject to considerable variation. Spacer 31 is tilted so that one end 33 is higher than the other. Then one end 33 is inserted in groove 17 and the other end 33 in groove 27. Spacer 31 is the n turned approximately horizontal. As shown in FIG. 5, spacer 31 has been inserted with a narrow side of dovetail 33 up. Because the thickness of dovetails 33 is approximately equal to the throats 18 and 26, an end 33 may be inserted in the groove 17 as an opposite end 33 is inserted in the groove 24. The mason then twists the spacer 31 about its longitudinal axis 90° and moves the spacer down to the position of FIG. 6, where one of the ends 33 rests on shelf 29 of unit 22. Because the spacer is in effect complementary to groove 24, the spacer 31 projects substantially horizontally toward the outer face shell 13.

After the inner structural element 11 and outer weatherskin element 21 have been built up in the manner heretofore described, foam insulation 37 is pumped or poured into the space between outer face shell 13 and weatherskin face shell 22.

As illustrated in FIG. 1, at corners, at least one of the blocks 22 may be cut away to form corner 44, a gain in conformity with conventional construction of concrete block walls. One block may be formed as a corner unit 45 to maintain running bond in the face shell units.

The construction of the inner structural element 11 provides utmost security for a building such as a prison, but even in other environments it functions essentially the same as a concrete masonry block wall. The weatherskin face shell units 22 provide a decorative exterior to the assembly. The particular advantage of the present invention is the fact the space between the two elements is filled with foam insulation 37 and that the spacers 31 interconnecting the weatherskin faceshell and inner structural element are very small in cross-section and are of a material such that heat transfer between the two elements by conduction is minimized. Thus, a wall constructed in accordance with the present invention with only a 2½ inch distance between the inner and outer walls, filled with polyurethane foam, and employing blocks for the inner wall with the dimensions of 12"w×8"h×16"l has an R value of 19.4.

For concrete masonry blocks made in accordance with U.S. Pat. No. 4,566,238, 8 inches of foam would be required for a value of R 11.5 where specifications require a normal weight mix of concrete blocks of 140 pounds per cubic foot (instead of a light weight construction of 100 pounds per cubic foot normally used). For a comparable wall to FIG. 1, the standard 16×8×16 (according to Patent '238) masonry unit would have an R value decrease from 9.8 to 5.5, with 3" of foam, when the PCF goes from 100 PCF to 140 PCF, since the heavy cross-webs through the foam cavity transfer almost double the heat loss or gain. Doubling the thickness of the foam from 3 inches to 6 inches is not an economical option. The R value of the present invention is not sensitive to a normal weight (140 PCF) structural elements.

The present invention employs two separate concrete blocks, the interior block being of a normal weight to satisfy specification (e.g., for a prison) while the plastic spacers provide an R value of 11.5 using only 1½ inches of foam. The cross-sectional area of a plastic connector is approximately 0.156 square inches whereas the two concrete cross-webs shown in the U.S. Pat. No. 4,566,238 are 11.5 square inches and the tensile strength thereof is less than that of the plastic spacers 31.

Figure 8:
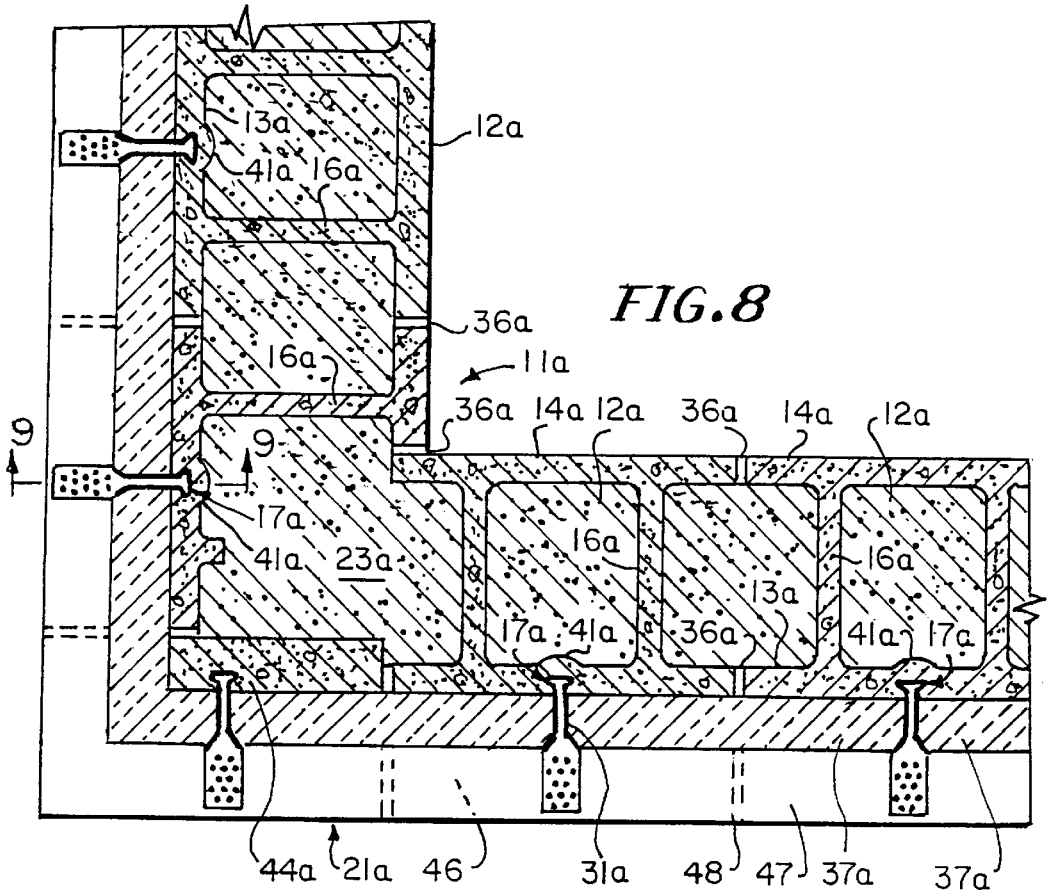
FIG. 8 is a view similar to FIG. 1 of another modification.
Figure 10:
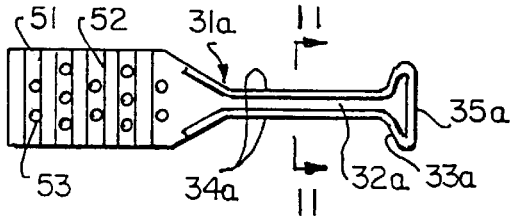
FIG. 10 is a top plan view of a spacer used with the modification of FIG. 8.
Figure 11:
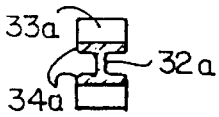
FIG. 11 is a sectional view taken substantially along the line 11—11 of FIG. 10.
Figure 9:
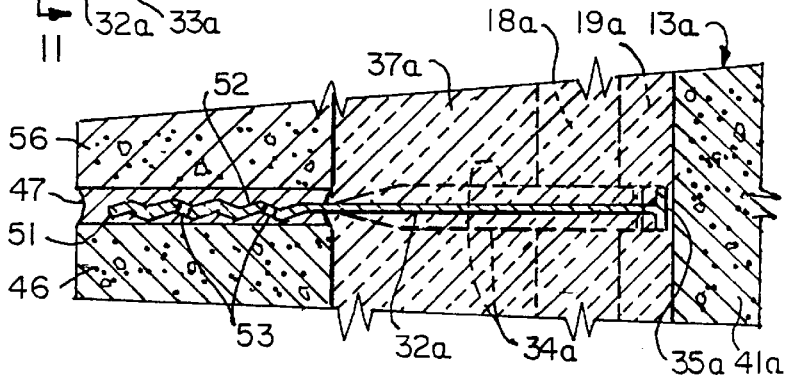
FIG. 9 is a view taken substantially along line 9—9 of FIG. 8.

FIG. 8 shows a modified construction. The outer wall or weatherskin 21*a* may be made of any type conventional clay bricks 46 in conventional or specially designed courses. The bricks 46 are held together by a mortar bedjoint 47 between courses and a mortar headjoint 48 between ends of individual bricks. In this modification the inner structural element 11*a* is shaped as in the preceding modification, as shown in FIG. 1.

Spacers 31*a* used in this modification have a center 32*a* having reinforced edges 34*a* and one end 33*a* having reinforced edges 35*a* as in the proceeding modification. The opposite end 51 is elongated and wider relative to end 33*a*. Further, in side elevation end 51 is formed with angularly placed waves 52. Holes 53 are formed in the angular waves.

When end 51 is placed into mortar bed 47 it is thoroughly embedded therein and held securely when the next course of bricks 51 is laid, as shown in FIG. 8.

Thus, in forming a wall in accordance with FIG. 8, after the inner structural element 11*a* is at least partially erected, the mason lays one or more courses of bricks 46 and then a mortar bed 47 on top of the uppermost bricks. End 33*a* of one spacer 31*a* is inserted vertically into in a mortise groove 17*a*, then rotated 90° about its axis and lowered until end 51 is pressed into mortar bed 47. Spacer 31*a* is held horizontal as additional mortar 47 is added on top of end 51. Mortar 47 fills the waves 52 and holes 53, anchoring spacer 31*a* in place. Thereupon another course of bricks may be laid on the mortar bed to lock spacer 31*a* securely in place.

In other respects the modification of FIGS. 8- resembles that of the previous modification and the same reference numerals followed by subscript a indicate corresponding parts. Bricks 46 may, of course, be laid at a different later time than inner structural element 11*a*.

Other outer weatherskin materials, such as limestone, marble, terra cotta, fieldstone, plastic panels or other materials may be substituted and, if required, the shapes of the connectors may be altered accordingly.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A wall construction comprising an inner structural element having an outer face, said outer face being formed with a first spacer receptor, an outer weatherskin element having an inner face formed with a second spacer receptor aligned with said first spacer receptor, said inner structural element being spaced from said outer weatherskin element, a spacer having a center portion and first and second ends shaped to engage within said first and second spacer receptors, respectively, said spacer receptors each having an inner portion and a throat slightly wider than said center portion of said spacer and narrower than a respective one of said spacer ends, and wherein the thickness of each said respective spacer end is narrower than a respective throat allowing said respective spacer end to pass through said respective throat and the width of each said respective spacer end is wider than said respective throat so as to prevent removal of each said respective spacer end from a respective spacer receptor and locate said outer weatherskin element a desired distance from said structural element upon 90° rotation of said spacer about its longitudinal axis, and wherein said spacer receptors have lengths substantially greater than the widths of said spacer ends, said spacers being located below an upper surface of said inner structural element a distance substantially greater than the widths of said spacer ends.

2. A wall construction according to claim 1 in which said ends are larger in cross-section than said center portion.

3. A wall construction according to claim 1 in which each said inner portion is shaped as a dovetail mortise and each of said spacer ends is shaped as a dovetail tenon.

4. A wall construction according to claim 3 in which each said spacer end is substantially complementary to a respective said dovetail mortise.

5. A wall construction according to claim 3 in which said spacer receptors are substantially identical and said spacer ends are substantially identical.

6. A wall construction according to claim 1 in which said center portion has reinforced edges to form a substantially "H" shaped cross-section.

7. A wall construction according to claim 1 in which said ends are wider than said throat in plan view and no wider than said throat in side elevation.

8. A wall construction according to claim 1 in which one of said spacer receptors is longer in a vertical direction than the other of said spacer receptors.

9. A wall construction according to claim 8 in which said other of said spacer receptors terminates in a horizontal shelf on which rests one of said spacer ends.

10. A wall construction according to claim 1 which further comprises foam plastic filling space between said outer face and said inner face.

11. A wall construction according to claim 10 in which said foam plastic fills said receptors.

12. A wall construction according to claim 1 in which said inner structural element comprises a plurality of courses of concrete blocks, said outer face comprising outer portions of said blocks.

13. A wall construction according to claim 1 in which said spacer is formed with reinforced edges and is generally rectangular in outline.

14. A wall construction according to claim 13 in which said center portion is substantially "H"-shaped in cross-section.

15. A method of forming a wall construction comprising the steps of:

positioning an inner structural element having an outer face, positioning an outer weatherskin element having an inner face spaced from said inner structural element, each said outer and inner faces including a groove having a throat and an inner portion, each said throat having a width, providing a spacer having a center with a longitudinal axis and first and second ends, each said end having a thickness less than the width of a respective said throat whereby each said end of said spacer is insertable into a respective said inner portion through said respective throat, each said end having a width greater than said width of said respective throat and less than the width of said respective inner portion, orienting said spacer such that said thickness of each said end is aligned with a respective said throat, inserting one of said first and second ends through a respective said throat into a respective said inner portion, and inserting the other of said first and second ends through a respective said throat into a respective said inner portion.

16. A method according to claim 15 further comprising the step of twisting said spacer 90° about said longitudinal axis such that said width of said ends prevents removal of said ends from said respective inner portions through said respective throats and said spacer locates said outer weatherskin element a desired distance from said structural element.

17. A method according to claim 16 in which said step of orienting said spacer comprises positioning said spacer with said one spacer end lower than said other spacer end and said step of inserting said one spacer end comprises leveling said spacer so that it is substantially horizontal while said inserting step is occurring and said step of twisting comprises turning said spacer so that said end width is substantially horizontal.

18. A method of forming a wall construction according to claim 15 in which said step of positioning an inner structural element is accomplished by laying at least one course of said inner structural element and in which said step of positioning an outer weatherskin element is accomplished by laying at least one course of said outer weatherskin element.

19. A method according to claim 18 which further comprises filling the spaces between both said elements with insulation.

20. A method according to claim 19 in which said step of filling comprises pouring foam plastic insulation.

21. A method according to claim 15 in which said step of inserting one of said first and second ends comprises tilting said spacer relative to the horizontal and inserting said one spacer end into a respective spacer receptor and lowering said other end into another respective spacer receptor and lowering said spacer to a horizontal position.

22. A wall construction comprising:

an inner structural element including an outer face having a first spacer receptor;

an outer weatherskin element including an inner face having a second spacer receptor aligned with said first spacer receptor, said outer weatherskin element being spaced from said inner structural element;

said first and second spacer receptors each including an inner portion and a throat narrower than said inner portion;

a spacer including a center portion and first and second ends, said center portion being slightly narrower than said throat, said first and second ends being wider than said throat and having a shape complimentary to the shape of said first and second inner portions, respectively;

wherein a thickness of said first and second spacer ends is narrower than said first and second throats, respectively, allowing a respective spacer end to pass through said respective throat and the width of said respective spacer end is wider than said respective throat so as to prevent removal of said respective spacer end from a respective spacer receptor through said respective throat and locate said outer weatherskin element a desired distance from said structural element upon 90° rotation of said spacer about its longitudinal axis.

23. A wall construction according to claim 22 wherein said spacer is monolithically formed of plastic.

24. A wall construction according to claim 22 further comprising foam insulation poured in situ between said inner structural element and said outer weatherskin element and around said spacer.

25. A wall construction according to claim 22 wherein said spacer provides said wall construction with an R value of 11.5 using only 1½ inches of polyurethane foam insulation between said inner and outer elements.

* * * * *

UNITED STATES PATENT AND TRADEMARK OFFICE

CERTIFICATE OF CORRECTION

PATENT NO. : 6,148,576
DATED : November 21, 2000
INVENTOR(S) : Peter Janopaul, Jr.

Figure 2:
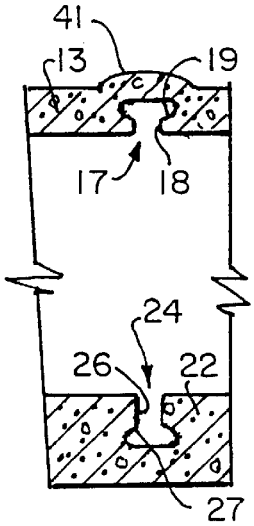
FIG. 2 is an enlarged fragmentary horizontal sectional view through portions of the inner and outer wall members prior to insertion of spacers.
Figure 3:
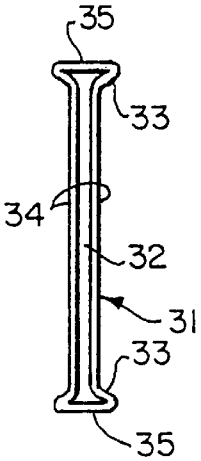
FIG. 3 is a top plan view of a spacer.
Figure 4:
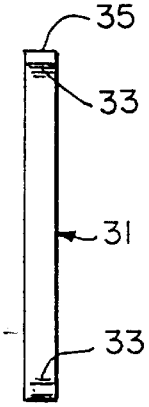
FIG. 4 is a side elevational view of the spacer of FIG. 3.

It is certified that error appears in the above-identified patent and that said Letters Patent is hereby corrected as shown below:

Drawings,
FIG. 2, insert line 5-5 and shelf 29 as illustrated on the next page.
FIG. 5, modify line 7-7 as illustrated on the next page.
FIG. 6, remove portions of crosshatching as illustrated on the next page and in conformance with FIG. 5.
FIG. 7, modify the leader line for groove 17 as illustrated on the next page and in conformance with FIG. 2.

Column 2,
Line 7, insert -- plan -- following "horizontal sectional".
Line 10, insert -- plan -- following "horizontal sectional".
Lines 23-24, change "FIG. 7 is a view similar to FIG. 2 of a modification before rotating 90°." to -- FIG. 7 is a fragmentary sectional view of the spacer before rotating 90° taken substantially along line 7-7 of FIG. 5. --.

Column 3,
Line 25, change "sufficient" to -- sufficiently --.
Line 28, change "slot" to -- slots --.
Line 59, change "the n" to -- then --.

Column 4,
Line 10, change "a gain" to -- again --.
Line 39, change "cross-webs" to -- crosswebs --

Column 5,
Line 15, change "FIGS. 8" to -- FIGS. 8-11 --.

Column 8,
Line 9, change "complimentary" to -- complementary --.

UNITED STATES PATENT AND TRADEMARK OFFICE

CERTIFICATE OF CORRECTION

PATENT NO. : 6,148,576
DATED : November 21, 2000
INVENTOR(S) : Peter Janopaul, Jr.

It is certified that error appears in the above-identified patent and that said Letters Patent is hereby corrected as shown below:

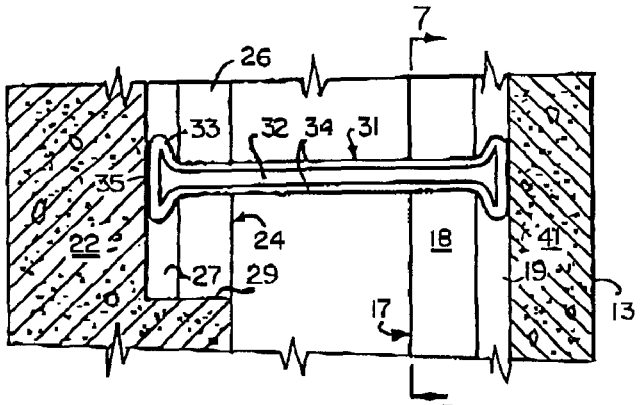

FIG.5

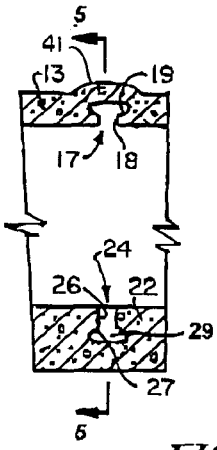

FIG.2

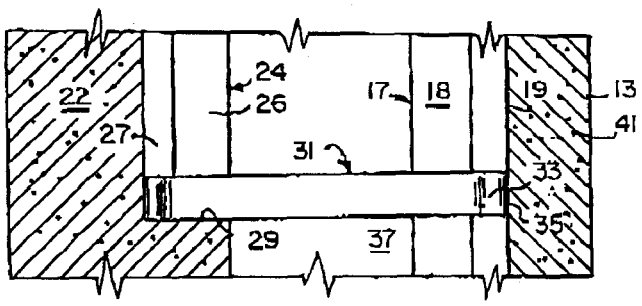

FIG.6

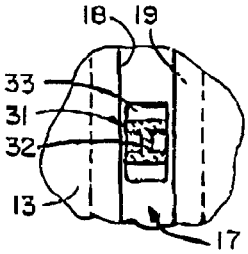

FIG.7

Signed and Sealed this

Thirtieth Day of July, 2002

*Attest:*

*Attesting Officer*

JAMES E. ROGAN
*Director of the United States Patent and Trademark Office*